United States Patent [19]

Elbel et al.

[11] Patent Number: 4,541,843

[45] Date of Patent: Sep. 17, 1985

[54] PROCESS FOR PRODUCING GRINDING ELEMENTS

[75] Inventors: Karl Elbel, Pforzheim; Rainer Augustin, Birkenfeld, both of Fed. Rep. of Germany

[73] Assignee: SEA Schleifmittel Entwicklung Anwendung GmbH, Pforzheim, Fed. Rep. of Germany

[21] Appl. No.: 572,544

[22] Filed: Jan. 20, 1984

[30] Foreign Application Priority Data

Oct. 21, 1983 [DE] Fed. Rep. of Germany ..... 3301925

[51] Int. Cl.[4] ..... C09K 3/14

[52] U.S. Cl. ..... 51/298; 51/293; 51/309

[58] Field of Search ..... 51/298, 293, 307, 309

[56] References Cited

U.S. PATENT DOCUMENTS

| | | | |
|---|---|---|---|
| 2,901,337 | 8/1959 | Keutgen et al. | 51/298 |
| 2,943,926 | 7/1960 | Goepfert | 51/298 |
| 3,208,836 | 9/1965 | Biglin et al. | 51/298 |
| 3,794,474 | 2/1974 | Megens | 51/298 |
| 3,804,607 | 4/1974 | Jungell | 51/298 |

*Primary Examiner*—Paul Lieberman
*Assistant Examiner*—W. Thompson
*Attorney, Agent, or Firm*—Spencer & Frank

[57] ABSTRACT

In a process for producing hard grinding elements, a synthetic resin having a dynamic viscosity of less than 10 mPa.s is used as the binder. By adding this binder, the mixture of abrasive grains, binders, and fillers is highly thixotropic and can easily be liquefied by vibration and can be filled into a casting mold having almost any desired shape where, due to the addition of a radical forming starter system to the mixture, the synthetic resin is polymerized. Methacrylic acid esters or vinyl acetates are particularly applicable as monomers for the binder.

16 Claims, 1 Drawing Figure

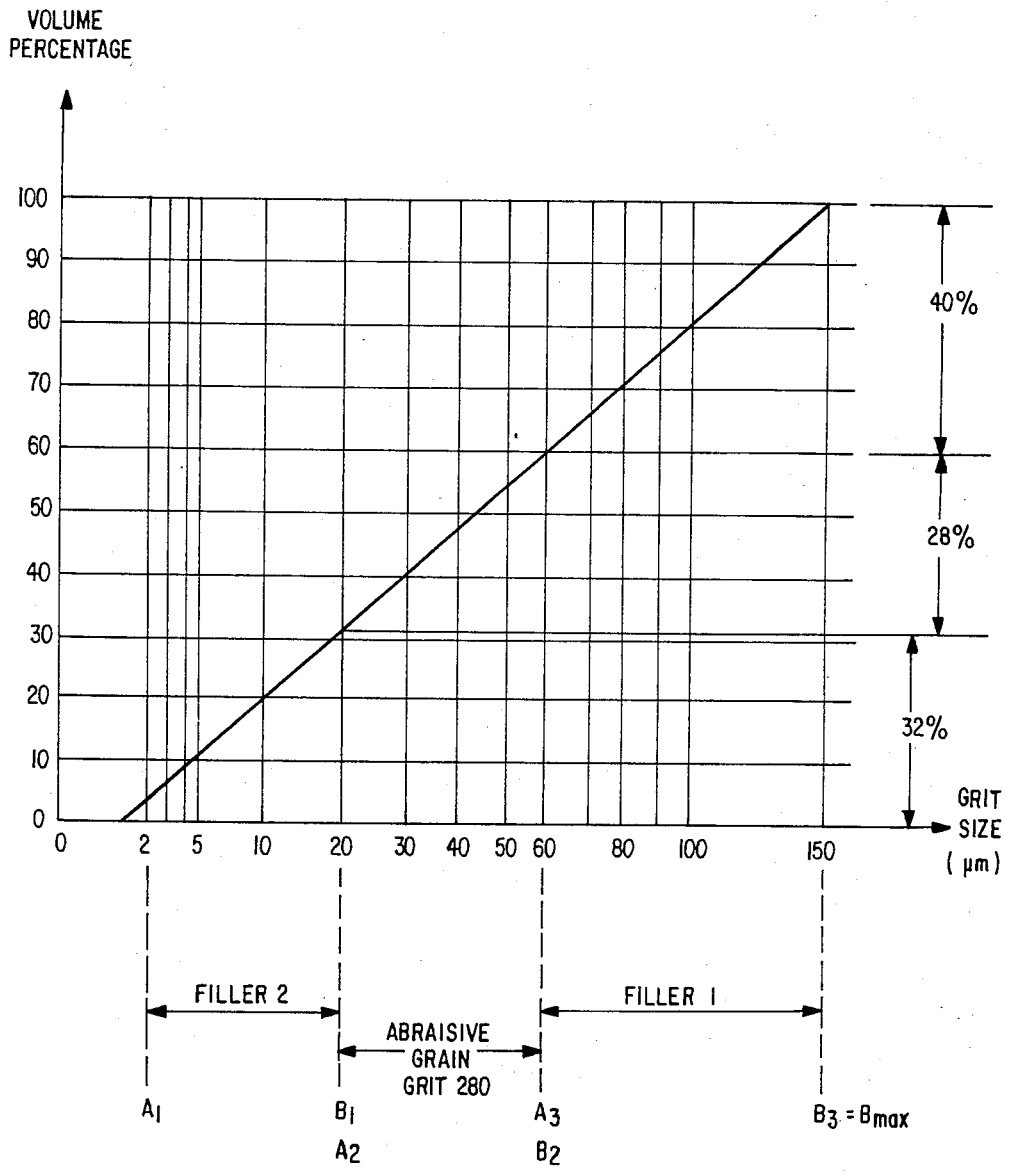
VOLUME PERCENTAGE
100
90
80
70
60
50
40
30
20
10
0
40%
28%
32%
GRIT SIZE (μm)
0
2
5
10
20
30
40
50
60
80
100
150
FILLER 2
ABRAISIVE GRAIN GRIT 280
FILLER 1
A1
B1
A2
A3
B2
B3 = Bmax

PROCESS FOR PRODUCING GRINDING ELEMENTS

BACKGROUND OF THE INVENTION

The present invention relates to a process for producing grinding elements in a casting mold, the process including the use of a cold hardening or setting synthetic resin as the binder in a mixture of abrasive grains and binder to which additives have possibly been added.

Such processes are employed in the production of hard grinding elements, i.e. grinding wheels, ring wheels, cup wheels, honing tools, etc.

In the abrasive producing industry, the view is represented that binders for such hard ("hard" to be understood here in contrast to elastomer) grinding elements which have high abrasive qualities can only be inorganic or duroplastic binders which have a high heat resistance because of the temperatures encountered during grinding, even with cooling.

The known, hard grinding elements are produced with the use of ceramic, phenolic resin, magnesite or epoxy resin binders (the less frequently used binders, such as metal, silicate, polyester and other binders are not considered here).

Vitrified bond grinding elements are used primarily for precision grinding. Due to the required firing for several days at temperatures above 900° C., their manufacture is expensive. Moreover, because of the shrinkage which occurs during firing, these elements must be considerably over-dimensioned, which necessitates corresponding work afterwards.

Phenolic resin bonds are based on the simultaneous use of phenolic resols and phenolic novolaks. Aside from the necessary hygienic measures during manufacture, the hardening process, which takes place at temperatures around 175° C. for a period of up to two days, also constitutes a threat to the environment since, in addition to water, considerable quantities of free phenol, formaldehyde and ammonia are released during this process. During cleaning of the mixers, such substances enter into the waste water together with the solvents, which necessitates complicated cleaning.

Both above-described types of bonds have the characteristic that the structure of the grinding element is porous, and in particular is very porous in the region of the coarse grains and less porous in the region of the fine grains. It is difficult, if not impossible, to set the density of the abrasive grains in such grinding elements over the entire grain size spectrum according to the specifically intended use, and particularly to provide a sufficient chip space volume in the region of the fine and finest grain sizes.

Additionally, phenolic resin bonds have the drawback that they have low resistance to the alkali coolants, so that this type of bond is used primarily only for dry grinding.

Grinding elements in magnesite bonds, in contrast to those in ceramic or phenolic resin binders, are cast and thus dense, i.e. practically free of pores. Nevertheless they offer extremely cool grinding, particularly for hardened steels, and have a high abrasive output. Therefore, such grinding elements are used primarily to sharpen knives, scissors, nippers and other tools, the ends of spiral springs and the like.

The drawbacks of grinding elements in magnesite bonds are many. For example, they can be used only for circumferential operating speeds up to 20 m/sec. Additionally, they change their hardness over time, so that they can be used to optimum efficiency only during a period from one to four months after manufacture. A further significant drawback is the magnesium chloride released during grinding, which leads to extensive corrosion, particularly on the protective hoods of the machines, and constitutes a considerable contamination of the waste waters.

Because of these drawbacks of magnesite bonds, epoxy resin bonds have increasingly been introduced in recent years, particularly in the cutlery industry, where they are employed with lower abrasive outputs and in the fine grain range. One handicap of epoxy resins is their high viscosity. Although basic resins containing a large amount of reactive diluter are available with viscosities of about 1000 mPa.s, they have insufficient heat resistance due to being diluted. Therefore, such grinding elements always constitute a compromise between just sufficient castability, resin proportion (which inevitably lies at 40 weight percent and higher), heat resistance and performance. Due to these necessary compromises with respect to heat resistance, such grinding elements can be used only for wet grinding.

Moreover, there are the hygienic dangers which exist when working with the primarily cold hardening resin systems due to the organic amines, epichlorohydrin remainders and reactive dilutants in the epoxy resin. Finally, the use of raw materials and the costs connected therewith are very high for grinding elements in epoxy resin bonds.

SUMMARY OF THE INVENTION

It is therefore the object of the present invention to further develop a process of the type initially mentioned so that grinding elements which can be put to many uses can be produced in a simpler and more economical manner.

This is accomplished by the present invention in that in a process for producing grinding elements in a casting mold including placing a mixture of abrasive grains, a cold hardening synthetic resin binder and other additives in a casting mold, and hardening the synthetic resin to form a grinding element; a synthetic resin having a dynamic viscosity of 1–10 mPa.s is used as the binder and a radical forming starter system is added, in a known manner, to the resin and/or the additives.

Preferably the mixture introduced into the mold also includes a filler material or materials, and possibly other additives, with the filler materials being selected according the particular use of the grinding element.

In a known manner, further additives can be added to the mixture of abrasive grain, binder and fillers so as to vary the characteristics of the grinding element to be produced. In particular, it is possible, by selection of the proportion of binder, to set the hardness of the grinding element being produced for its respective intended use.

The synthetic resin used as the binder is preferably a momomer such as a methacrylic acid ester or vinyl acetate which, due to the addition of the radical starting system, is polymerized in the mold. In any case, the resin and radical forming starter system selected should be such that hardening or setting takes place in the mold at room temperature or possibly up to a maximum temperature of 60° C.

Due to their composition according to the present invention, the mixtures of abrasive grain, filler and binder are highly thixotropic and can easily be liquified by means of vibration. Their consistency while being vibrated appropriately is such that they can easily pass through the outlet of a funnel and neatly fill even complicated casting molds. It is here possible, for example, to produce cup wheels having wall thicknesses of only 3 mm for a cup diameter of 250 mm, which had not been possible with the prior art binders.

DETAILED DESCRIPTION OF THE PREFERRED EMBODIMENTS

As indicated above, according to the basic concept of the present invention, in a method of producing hard grinding elements, a synthetic resin having a dynamic viscosity of less than 10 mPa.s is used as the binder material, and a radical forming starter system for the resin is added to the resin and/or the additives. By using such a binder material, the mixture of abrasive grains, binder and other additives, including fillers, is highly thixotropic and can easily be liquefied by vibration and can be filled into a casting mold which may have almost any desired shape and wherein, due to the addition of the radical forming starter system for the resin to the mixture, the synthetic resin is polymerized. Preferably the synthetic resin is a polymerizable liquid such as vinyl acetate and/or a methacrylate.

The addition of the starter system can be dosaged in such a manner that a sufficient pot life is realized, that unmolding of the hardened grinding element can take place at the latest two hours after the beginning of mold filling, and that hardening or setting takes place essentially at room temperature. Only in the case of small grinding elements, where inevitably the large relative mold volume compared to the small relative grinding element volume takes up much reaction heat, is it advisable to briefly heat the molds to 60° C. before or after filling.

Advisably, the starter system includes an organic peroxide and an aromatic tertiary amine. It has here been found to be favorable to mix a powdered organic peroxide in with the abrasive fillers and to dissolve the aromatic tertiary amine in the binder. Examples for peroxides are: cumene hydroperoxide $H_5C_6—C(CH_3)_2(OOH)$ and benzoylperoxide $C_6H_5CO—O—O—COC_6H_5$. Aromatic tertary amines that can be used in the starter system are Dimethylparatoluidine $H_3C—H_4C_6—N(CH_3)_2$, Diethylolparatoluidine $H_3C—M_4C_6—N(CH_2—CH_2—OH)_2$ and Diisopropylolparatoluidine $H_3C—M_4C_6—N(C(CH_3)_2OH)_2$.

Shrinkage due to hardening in the grinding elements produced according to the present invention is extremely slight and is, on the average, 0.02%. This fact makes it possible to design the respective mold so that the parts of the grinding element resting against the mold require no further work. This applies even to a bore, if the bore mandrel has a correspondingly slight overdimension. Thus considerable manufacturing costs can be saved compared to the prior art processes.

Due to the low shrinkage during hardening, it is also very easy to directly integrate metal parts. These may be reinforcements as well as threaded sleeves, shafts for small grinding elements, etc.

Due to their manufacture according to the present invention, the grinding elements exhibit practically no eccentricity and there are no density or hardness differences within the finished element, if the casting mold is geometrically perfect.

The grinding element produced according to the present invention competes in various areas of surface machining with vitrified, phenolic resin, magnesite and epoxy resin bonds. The table found in the appendix gives an overview of the relevant conditions for manufacture and use of the various type grinding elements, with a plus sign indicating a positive evaluation and a minus sign a negative evaluation. This compilation clearly indicates the positive characteristics of the process according to the present invention as a whole compared to prior art processes.

Surprisingly, it has further been found that thermoplastics can also be used for the manufacture of hard grinding elements, with the polymerization of the monomer in the grinding element mixture taking place in the casting mold. The monomers may possibly be stabilized with 3 to 20 ppm hydroquinone or other stabilizers. Such monomers are primarily methacrylic acid esters and/or vinyl acetate. However, other monomers are conceivable for use alone or as additives, but it must then be considered that some of the monomers in question are objectionable with respect to working hygiene. Methacrylic acid esters that can be used are $$H_2C=C(CH_3)—CO—R$$

$$R=C_nH_{2n+1}$$

Advisably, the binder material according to the present invention contains bifunctional or trifunctional methacrylates as crosslinking agents, for example Butandiol-1,4-dimethacrylate:

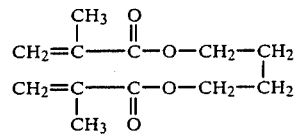

To produce the necessary chip space volume between the grains and to enable polymerization to take place at all, fillers are required. These fillers must be softer, on the one hand, than the materials to be worked by the grinding elements but must, on the other hand, be pressure resistant enough that they rigidly fix the abrasive grains and impart the necessary hardness to the grinding element as a whole.

For this purpose, the fillers preferably used are those fillers which have a Mohs hardness of less than 6 or a Knoop hardness of less than 500, which are available in various grit size graduations, which are environmentally acceptable, and which possibly make the grinding result produced by the abrasive grains finer in that they act as polishing agent. Such preferred fillers are water insoluble calcium compounds, such as calcite, dolomite, aragonite, gypsum, selenite and/or estrich gypsum.

To minimize the amount of binders required and simultaneously optimally support and rigidly fix the abrasive grain, the granulometric composition of the abrasive grain-filler combination should essentially correspond, with respect to its volume, to the respective Fuller curve. This assures the tightest possible packing of the inorganic components.

The "Fuller curve" indicates the share $S_i$ (volume-percentage) of a component i in a granulometric composition, if the particles of this component i cover a predetermined diameter-range from $A_i$ to $B_i$ with $S_i$ $(B_{max})=100\%$, $B_{max}$=maximum diameter.

It may here turn out to be quite useful for the Fuller curve to, for example, begin with an abrasively neutral filler in the range from 150 to 60 microns, to include the abrasive grain 280 in the range from 60 to 20 microns, and then to again include an abrasively neutral filler in the range from 20 to 2 microns. It is advisable to surface treat the fillers primarily in the fine range from 20 to 2 microns, a process that can be handled by Plüss-Staufer AG in 4665 Oftringen, Switzerland. An example of the Fuller curve for the granulometric 3-components composition indicated above is shown in FIG. 1 of the drawing.

The setting of the Fuller curve substantially to correspond to the respective abrasive grain size makes it possible to keep the binder content relatively low, in the extreme case at 8 weight percent or 20 volume percent, respectively. In the range of "medium" hardness, the binder content lies at 16 weight percent or 40 volume percent, respectively. This is meant to indicate that the "hardness" can here be set similarly to the respective intended use similarly as for grinding elements containing hard bonds, a distinction also being made between "hard" and "soft" ceramic or bakelite wheels. The term "hardness" is here more or less understood to mean the strength of the grain bond.

As is customary with the known grinding elements, for example those with phenolic resin bonds, it is also possible for the mixture according to the present invention to be modified by additives. Such additives are, for example, grinding aids such as cryolite, iron pyrite or the like, insofar as they are considered in the calculation of the Fuller curve.

For dry grinding, clogging of the grinding surface can be suppressed by the addition of suitable metal or amine soaps. Here again the Fuller curve must be considered.

The same applies if short glass or carbon fibers are added to increase the permissible circumferential speed. Moreover, the use of glass fabrics or rovings as reinforcement materials is of course also possible. Since oxygen from the air inhibits polymerization, the grinding elements according to the present invention must be essentially dense. However, when grinding heat sensitive steels it may be useful, in order to increase the transport of water based coolants, to produce a more open surface on the grinding element. This can be done very well by the addition of water soluble powdered substances. One of these, which is excellently suitable, is ground waterglass which not only has a corrosion inhibiting effect but is also environmentally acceptable and does not adversely influence the coolants.

All known types of abrasive grains can be used, i.e. glass, flint, garnet, the various corundums, silicon carbide and the like, either alone or in mixture. As already mentioned, all grit sizes are possible, for example, those between FEPA 8 and 1200, which correspond to a grain diameter range from approximately 5 microns to 3 mm. For example "280 F 37" indicates a grit size with an average diameter of 37 microns, 94% of the particles having a diameter exceeding 26 microns, 3% exceeding 65 microns. The european FEPA standard (Federation europeenne des fabricants de produits abrasifs standard) essentially corresponds to U.S.-standard "ASTM".

The following examples may illustrate the process according to the invention and the use of specific granulometric compositions therein; use is made of corundum "Durcal 130" (Plüss-Staufer AG, Switzerland)=calcium-carbonate, grit size from 40 to 400 microns "Durcal 40", as "Durcal 130" but grit size from 10 to 200 microns, "Calibrite" (Plüss-Staufer AG, Switzerland) as filler, grit size from 7 to 70 microns, "BLR 3" (Plüss-Staufer AG, Switzerland) as filler, grit size from 2 to 20 microns, surface treated, "microballoons" (Union Carbide) Nitrogen-Filled balloons of phenolic resin range from 5 to 150 microns, Na-soap (Bärlocher GmbH, München, West-Germany) a mixture of Nastearate and Na-palmitate.

BPO 50%, benzoylperoxide (50%) and an explosion inhibiting additive (50%); BPO is the radical forming component starting the polymerisation when brought together with the starter component included in the binder components.

The binder is composed of:

| | |
|---|---|
| Methylmethacrylate | 85 weight % |
| hydroquinone (inhibitor) | 1 weight % |
| Butandiol-1,4-di-methacrylate | 2 weight % |
| Diethylolparatoluidine (starter for BPO) | 2 weight % |
| Polymethylmethacrylate | 10 weight % |

The dynamic viscosity of such a binder composition (room temperature) amounts to 0:9 . . . 1:2 mPas.s.

EXAMPLE 1

| | |
|---|---|
| corundum grit 60 | 51.8 weight % |
| Durcal 130 | 20.0 weight % |
| BLR 3 | 13.3 weight % |
| microballoons | 0.5 weight % |
| Na—soap | 3.3 weight % |
| BPO 50% | 0.4 weight % |
| binder (as listed above) | 10.7 weight % |

This composition can be used for the production of grinding wheels, diameter 1000 mm, for grinding of the ends of spiral springs of railway carriages. The grinding wheels according to the invention show a better performance compared to usually used types based on magnesite bonding, especially for extremely cool grinding and high abrasive output.

EXAMPLE 2

| | |
|---|---|
| corundum grit 120 | 26.0 weight % |
| corundum grit 150 | 20.0 weight % |
| Durcal 40 | 6.6 weight % |
| Calibrite | 12.5 weight % |
| BLR 3 | 18.8 weight % |
| BPO 50% | 0.5 weight % |
| binder (as listed above) | 15.6 weight % |

This composition can be used for the production of ring wheels, outer diameter 450 mm, inner diameter 350 mm, height 120 mm. These ring wheels are used to sharpen knives.

EXAMPLE 3

| | |
|---|---|
| corundum grit 80 | 25.7 weight % |
| corundum grit 100 | 28.4 weight % |
| corundum grit 180 | 2.2 weight % |
| Durcal 130 | 4.2 weight % |
| Durcal 40 | 9.6 weight % |

-continued

| | |
|---|---|
| BLR 3 | 14.1 weight % |
| microballoons | 0.7 weight % |

Appendix

| | Conditions, important problems and tasks to be solved | Types of bonds: Vitrified bond | Phenol resin bond | Magnesite bond | Epoxy resin bond | Bond according to present invention |
|---|---|---|---|---|---|---|
| | Toxicity during processing | + | − | + | − | + |
| Manufacture | Mold filling, costs and time | − | − | + | o | + |
| | Bond hardening Time | — | − | − | o | + |
| | Energy consumption for hardening | — | − | + | + | + |
| | Costs for subsequent working | — | − | + | + | + |
| | Environmental pollution by exhaust gases | o | − | + | + | + |
| | Environmental pollution by waste waters | + | − | − | + | + |
| | Subsequent hardening or storage required | + | + | — | + | + |
| | Use of raw materials, costs | + | o | + | — | + |
| | Extra protection required | + | + | + | + | − |
| | Complicated shapes possible | − | o | o | + | + |
| | Shrinkage or accuracy of shape dimensions, | — | − | — | + | + |
| Use | Dry grinding | + | + | − | − | + |
| | Wet grinding | + | − | + | + | + |
| | Coolant and oil resistance | + | − | − | + | + |
| | Resistance to breakage and shocks | − | + | — | + | + |
| | Additional reinforcement possible | − | + | − | + | + |
| | High operating speed | o | + | — | + | + |
| | Can be used in all grain sizes | o | o | o | o | + |
| | Hardness setting variable | + | + | o | o | + |
| | Storage stability | + | o | — | + | + |
| | Homogeneity | − | − | + | + | + |
| | Environmental pollution by waste waters | + | / | − | o | + |
| Miscellaneous | Dependence on climate | o | − | — | + | + |
| | Machine corrosion | + | + | — | + | + |
| | Danger of allergic reactions | + | − | + | − | + |

| | |
|---|---|
| BPO 50% | 0.5 weight % |
| binder | 14.6 weight % |

In the binder 25% of the methylmethacrylate-component was substituted by vinylacetate, resulting in a "soft" grinding composition. This composition was used for the production of ring wheels for the grinding of putty-knives; the surface treated with the grinding elements was so smooth, that polishing could take place immediately thereafter.

The components listed in Examples 1 to 3 respectively are mixed until a homogenous mixture is achieved.

The casting mold whose shape is complementary to the shape of the desired grinding element is rigidly mounted on a table or the like which itself is provided with springs or similar elements, so that it is able to vibrate, when connected to a vibrator. The vibrator has a vibration frequency of 0.3 to 1kHz (300 to 1000 $sec^{-1}$). The mixture of the components is also vibrated in its container; due to the specific quality of the mixture, the latter is liquified and poured into the casting mold, neatly filling even casting spaces of only 4 mm width.

Due to the exothermic polymerisation process starting in the casting mold thereafter, the mold and the grinding element formed therein will be heated up to approximately 60° Celsius. It will normally take about one hour for the grinding element to harden. After that period the grinding element can be taken out of the mold.

In case of the production of small grinding elements, wherein the mold absorbs most of the reaction heat, it may be useful to heat the mold to approximately 60° Celsius before casting or after.

It will be understood that the above description of the present invention is susceptible to various modifications, changes and adaptations, and the same are intended to be comprehended within the meaning and range of equivalents of the appended claims.

What is claimed is:

1. In a process for producing grinding elements in a casting mold including placing a mixture of abrasive grains, a cold hardening synthetic resin binder, and other additives into a casting mold, and hardening the synthetic resin to form the grinding element; the improvement wherein: said abrasive grains and other additives have minimum particle sizes, particle size distributions and relative proportions essentially corresponding to the respective Fuller curve, thereby providing a non-compactable thixotropic mixture having the tightest possible packing of abrasive grains and other additives; said synthetic resin used as said binder consists of one or more polymerizable liquids and has a dynamic viscosity of less than 10 mPa.s; a radical forming starter system for said resin is added, in a known manner, to said mixture, and said thixotropic mixture is liquified by vibration prior to hardening.

2. The process defined in claim 1 wherein said additives include a filler material having a particle size distribution which includes the minimum particle size presented by the respective Fuller curve.

3. The process defined in claim 1 wherein said polymerizable liquid comprises vinyl acetate or a methacrylate ester.

4. The process defined in claim 1 wherein said mixture is hardened in the casting mold, and the hardening takes place at a temperature in the range from room temperature up to a maximum of 60° C.

5. The process as defined in claim 1 wherein said starter system includes an organic peroxide and an aromatic tertiary amine.

6. The process defined in claim 1 wherein said synthetic resin is a methacrylate resin which contains bifunctional or trifunctional methacrylates as a crosslinking agent.

7. The process defined in claim 1 wherein said additives include filler material having a Knoop hardness of less than 500.

8. The process defined in claim 7 wherein said filler material is, at least in part, surface treated.

9. The process defined in claim 7 wherein said filler material comprises calcite, dolomite, aragonite, gypsum, selenite or estrich gypsum.

10. The process defined in claim 1, wherein the abrasive grains, the cold hardening synthetic resin binder and the other additives are first combined in a mixing vessel and mixed until a homogeneous thixotropic mixture is obtained, the mixture is thereafter introduced into the casting mold by gravity without compacting and allowed to reside in the mold for a sufficient time for polymerization to form a hard casting, and the homogeneous mixture is vibrated in the mixing vessel or the casting mold until it becomes liquefied before polymerization takes place.

11. The process defined in claim 1, wherein the abrasive grains and the other additives comprise corundum grit, calcium carbonate, filler, nitrogen filled phenolic resin balloons, sodium stearate, sodium palmitate, benzoylperoxide, and an explosion inhibitor, and wherein the cold hardening synthetic resin binder comprises methylmethacrylate, hydroquinone, butanediol-1,4-di-methacrylate, diethylolparatoluidine, and polymethylmethacrylate.

12. The process defined in claim 1, wherein the abrasive grains and the other additives comprise corundum grit, calcium carbonate, filler, benzoylperoxide, and an explosion inhibitor, and wherein the cold hardening synthetic resin binder comprises methylmethacrylate, hydroquinone, butanediol-1,4-di-methacrylate, diethylolparatoluidine, and polymethylmethacrylate.

13. The process defined in claim 1, wherein the abrasive grains and the other additives comprise corundum grit, calcium carbonate, filler, nitrogen filled phenolic resin balloons, benzoylperoxide, and an explosion inhibitor, and wherein the cold hardening synthetic resin binder comprises methylmethacrylate, hydroquinone, butanediol-1,4-di-methacrylate, diethylolparatoluidine, and polymethylmethacrylate.

14. The process defined in claim 1, wherein the cold hardening synthetic resin binder comprises at least 90 weight percent monomer.

15. The process defined in claim 1, wherein the cold hardening synthetic resin binder comprises 100 percent monomer.

16. The process defined in claim 2, wherein the minimum particle size is $2\mu$.

* * * * *

UNITED STATES PATENT AND TRADEMARK OFFICE

CERTIFICATE OF CORRECTION

PATENT NO. : 4,541,843

DATED : September 17th, 1985

INVENTOR(S) : Karl Elbel and Rainer Augustin

It is certified that error appears in the above-identified patent and that said Letters Patent is hereby corrected as shown below:

In the heading of the patent, under [30] Foreign Application Priority Data, change "Oct. 21, 1983" to --Jan. 21, 1983--.

Signed and Sealed this

*Tenth* Day of *December 1985*

[SEAL]

*Attest:*

DONALD J. QUIGG

*Attesting Officer*

*Commissioner of Patents and Trademarks*